US008181365B2

(12) United States Patent
Cass et al.

(10) Patent No.: US 8,181,365 B2
(45) Date of Patent: May 22, 2012

(54) ARTICLE OF FOOTWEAR INCLUDING IMPROVED HEEL STRUCTURE

(75) Inventors: William J. Cass, Portland, OR (US); Peeramet Simpliphant, Portland, OR (US); Daniel A. Williamson, St. Paul, OR (US)

(73) Assignee: Nike, Inc., Beaverton, OR (US)

( * ) Notice: Subject to any disclaimer, the term of this patent is extended or adjusted under 35 U.S.C. 154(b) by 455 days.

(21) Appl. No.: 12/494,762

(22) Filed: Jun. 30, 2009

(65) Prior Publication Data

US 2010/0325917 A1 Dec. 30, 2010

(51) Int. Cl.
*A43B 13/18* (2006.01)

(52) U.S. Cl. ..... 36/103; 36/28; 36/35 R

(58) Field of Classification Search ..... 36/103, 36/28, 35 R, 25 R, 27, 30 R
See application file for complete search history.

(56) References Cited

U.S. PATENT DOCUMENTS

| | | | | |
|---|---|---|---|---|
| 5,279,051 | A | 1/1994 | Whatley | |
| 5,353,526 | A | 10/1994 | Foley et al. | |
| 5,367,792 | A | 11/1994 | Richard et al. | |
| 5,628,128 | A | 5/1997 | Miller et al. | |
| 5,797,199 | A | 8/1998 | Miller et al. | |
| 6,457,261 | B1 | 10/2002 | Crary | |
| 6,568,102 | B1 | 5/2003 | Healy et al. | |
| 6,625,905 | B2 * | 9/2003 | Kita | 36/30 R |
| 6,647,645 | B2 | 11/2003 | Kita | |
| 6,769,202 | B1 | 8/2004 | Luthi et al. | |
| 6,964,120 | B2 | 11/2005 | Cartier et al. | |
| D523,628 | S * | 6/2006 | Young | D2/977 |
| 7,080,467 | B2 | 7/2006 | Marvin et al. | |
| 7,178,267 | B2 | 2/2007 | Skaja et al. | |
| 7,334,349 | B2 * | 2/2008 | Sokolowski et al. | 36/25 R |
| 7,350,320 | B2 | 4/2008 | Chandler et al. | |
| 7,360,324 | B2 | 4/2008 | Aveni | |
| 7,377,057 | B2 | 5/2008 | Lacorazza et al. | |
| D570,078 | S * | 6/2008 | Davis | D2/953 |
| 7,383,647 | B2 | 6/2008 | Chan et al. | |
| 7,395,616 | B2 | 7/2008 | Fallon | |
| 7,401,419 | B2 | 7/2008 | Lucas et al. | |
| 7,437,835 | B2 | 10/2008 | Marvin et al. | |
| 7,441,346 | B2 | 10/2008 | Hardy et al. | |
| 7,448,149 | B2 | 11/2008 | Preskar et al. | |
| 7,458,172 | B2 | 12/2008 | Aveni | |
| 7,464,489 | B2 | 12/2008 | Ho | |
| 7,484,317 | B2 | 2/2009 | Kita et al. | |
| 7,493,708 | B2 | 2/2009 | Crowley, Jr. | |
| 7,513,065 | B2 | 4/2009 | Kita et al. | |
| 2006/0112592 | A1 | 6/2006 | Leedy et al. | |
| 2006/0248749 | A1 | 11/2006 | Ellis | |
| 2007/0266593 | A1 * | 11/2007 | Schindler et al. | 36/28 |
| 2008/0052965 | A1 | 3/2008 | Sato | |
| 2008/0086916 | A1 | 4/2008 | Ellis | |
| 2008/0127513 | A1 | 6/2008 | Schinlder et al. | |

* cited by examiner

*Primary Examiner* — Ted Kavanaugh
(74) *Attorney, Agent, or Firm* — Harness, Dickey & Pierce, P.L.C.

(57) ABSTRACT

An article of footwear is provided and includes an upper structure having a heel portion and a forefoot portion and a plate attached to a bottom surface of the upper structure. A sole structure is attached to the plate and includes a first portion associated with the heel portion and a second portion associated with the forefoot portion. The first portion includes a wall formation having a continuous structure with a series of peaks disposed proximate to and in contact with the plate and a series of valleys cooperating with the peaks to define a plurality of pockets formed through the wall formation.

18 Claims, 5 Drawing Sheets

ARTICLE OF FOOTWEAR INCLUDING IMPROVED HEEL STRUCTURE

FIELD

The present disclosure relates to footwear, and more particularly, to an article of footwear including a midsole having a serpentine construction and an embedded outsole.

BACKGROUND

This section provides background information related to the present disclosure which is not necessarily prior art.

Conventional footwear typically includes an upper structure and a sole structure that cooperate to support a foot during use. The upper structure securely receives and positions the foot while the sole structure, which is typically secured to a lower portion of the upper structure and generally between the foot and a ground surface, attenuates reaction forces by absorbing energy as the footwear contacts the ground.

In addition to positioning a foot and absorbing energy during use, modern articles of footwear also concurrently provide a user with comfort, style, and enhanced athletic performance. For example, in one configuration, athletic footwear may provide a long-distance runner with support and comfort during use while concurrently enhancing the ability of the athlete to run long distances. Such a balance between function (i.e., support and comfort) and performance is often achieved by selecting materials that provide adequate support to a foot during use while concurrently being relatively light in weight.

In an effort to strike an optimum balance among support, comfort, style, and performance, footwear manufacturers have recently not only varied the materials chosen for the upper structure and for the sole structure, but have also separated the sole structure into two unique zones: a metatarsal head or forward region disposed proximate to the ball of a foot and a calcaneus or heel region disposed proximate to the heel of the foot. Separating the sole structure into two discrete regions allows manufacturers to tailor the performance of each region through material selection and/or structure.

Separating the sole structure into the forward region and heel region also allows footwear manufacturers to incorporate materials into the respective regions that are appropriate for each region. For example, a footwear manufacturer may incorporate a somewhat flexible material into the forward region along with an accompanying segmented structure that cooperate to allow the forward sole structure to flex in response to bending of a foot during walking or running. A similar approach may be applied to the heel region, which may incorporate an air bladder or other shock-absorbing columnar structure that is used in conjunction with a relatively hard material disposed on an undersurface of the heel region to absorb and cushion impact of a heel during walking or running.

SUMMARY

This section provides a general summary of the disclosure, and is not a comprehensive disclosure of its full scope or all of its features.

An article of footwear is provided and includes an upper structure having a heel portion and a forefoot portion and a plate attached to a bottom surface of the upper structure. A sole structure is attached to the plate and includes a first portion associated with the heel portion and a second portion associated with the forefoot portion. The first portion includes a wall formation having a continuous structure with a series of peaks disposed proximate to and in contact with the plate and a series of valleys cooperating with the peaks to define a plurality of pockets formed through the wall formation.

A sole structure for an article of footwear having an upper structure and a heel portion is provided. The sole structure has a first portion associated with the heel portion and includes a wall formation having a continuous structure with a series of peaks disposed proximate to and in contact with the upper structure and a series of valleys cooperating with the peaks to define a plurality of pockets formed through the wall formation.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
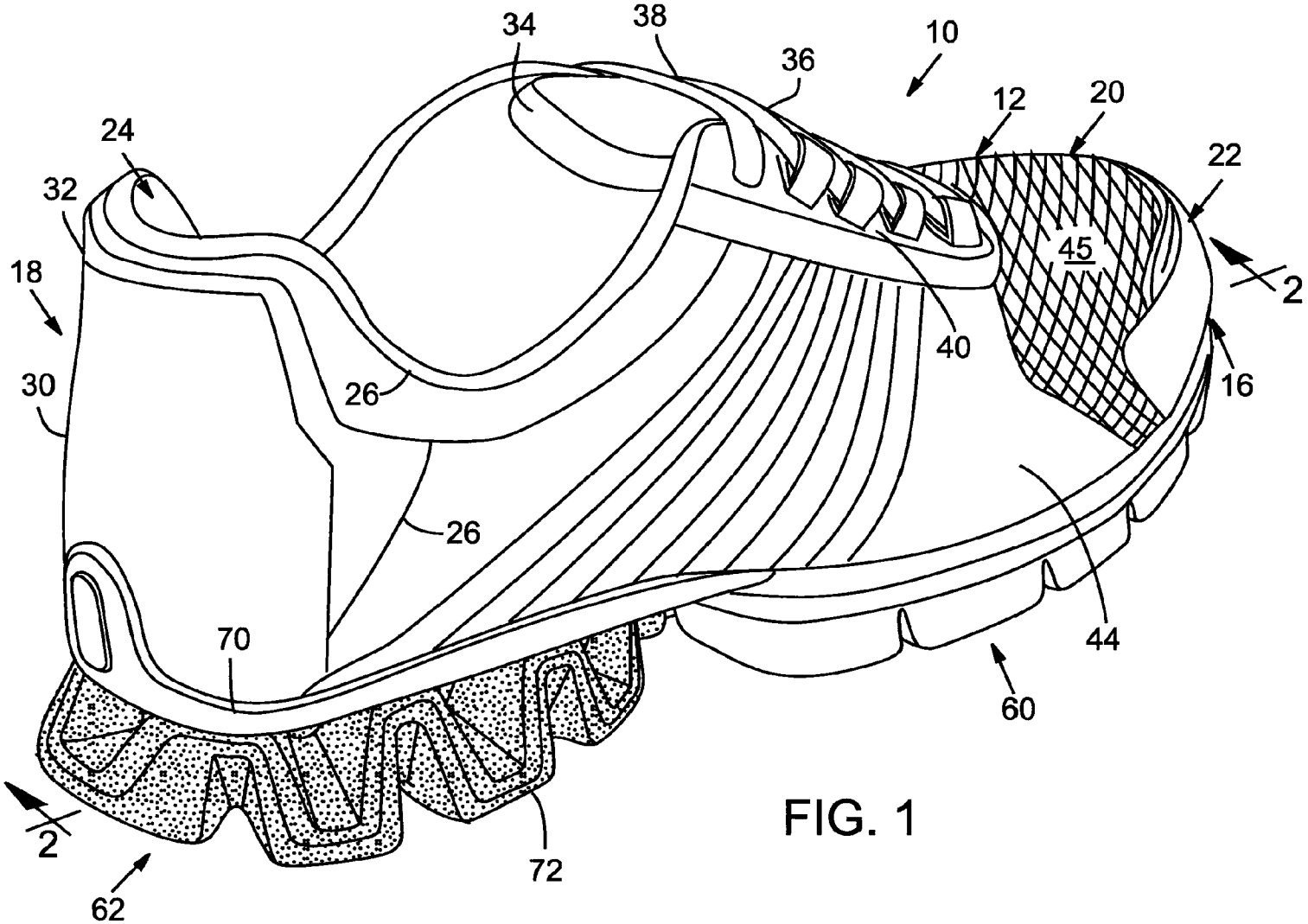
FIG. 1 is a perspective view of an article of footwear in accordance with the teachings of the present disclosure.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

With reference to the figures, an article of footwear 10 is provided and includes an upper structure 12 that selectively receives a foot 14 (FIG. 3) of a user and a sole structure 16 providing support and cushioning to the foot 14 during use.

The upper structure 12 includes a rear 18, a vamp 20, a toe box 22, and a liner 24, which are joined together through stitching 26, high-frequency welding, and/or via an epoxy. The upper structure 12 is fastened to the sole structure 16 for securely retaining the foot 14 and may be formed of a material that concurrently protects that foot 14 and provides ventilation for cooling and removing perspiration.

The rear 18, or back portion of the article of footwear 10, protects the wearer's calcaneus or heel bone and minimizes relative movement between the foot 14 and the article of footwear 10 during use. To this end, the rear 18 may include a heel counter 30 providing stiffening properties for the rear of the article of footwear 10 and a topline 32 for bringing the rear 18 into contact with the foot 14.

The vamp 20 generally covers the instep and toes of the foot 14 and further includes a tongue 34 and laces 36. The vamp 20 is typically separated into a medial portion 38 and a lateral portion 40, which correspond to the medial and lateral sides 42, 44 of the article of footwear 10. The tongue 34 is disposed generally between the medial and lateral portions 38, 40 and may be formed from the same or different material as the medial portion 38 and lateral portion 40. The tongue 34 improves the overall aesthetics of the article of footwear 10 and protects a top portion of the foot 14 by preventing the laces 36 from rubbing against the top portion of the foot 14. The laces 36 draw the medial and lateral portions 38, 40 of the vamp 20 towards one another for securing the vamp 20 around the foot 14. As shown, the vamp 20 is made from a variety of materials such as leather and synthetic materials, which are strategically placed for both functional and aesthetic purposes. For example, in one construction, a synthetic mesh material 45 is placed over a front portion of the foot 14 to allow air to move into and out of the article of footwear 10 to cool the foot 14.

The toe box 22 covers and protects the front portion of the foot 14 and may be formed from a relatively durable material to protect the upper structure 12 from scuffing and to protect the front portion of the foot 14 during use.

The liner 24 is disposed generally within an interior portion of the article of footwear 10 and is positioned such that when the foot 14 is received within the article of footwear 10, the liner 24 is in direct contact with portions of the foot 14. The liner 24 is formed from a generally soft material formed over a layer of cushioning material to both provide the foot 14 with a degree of comfort while also protecting the foot 14 during use.

Figure 2:
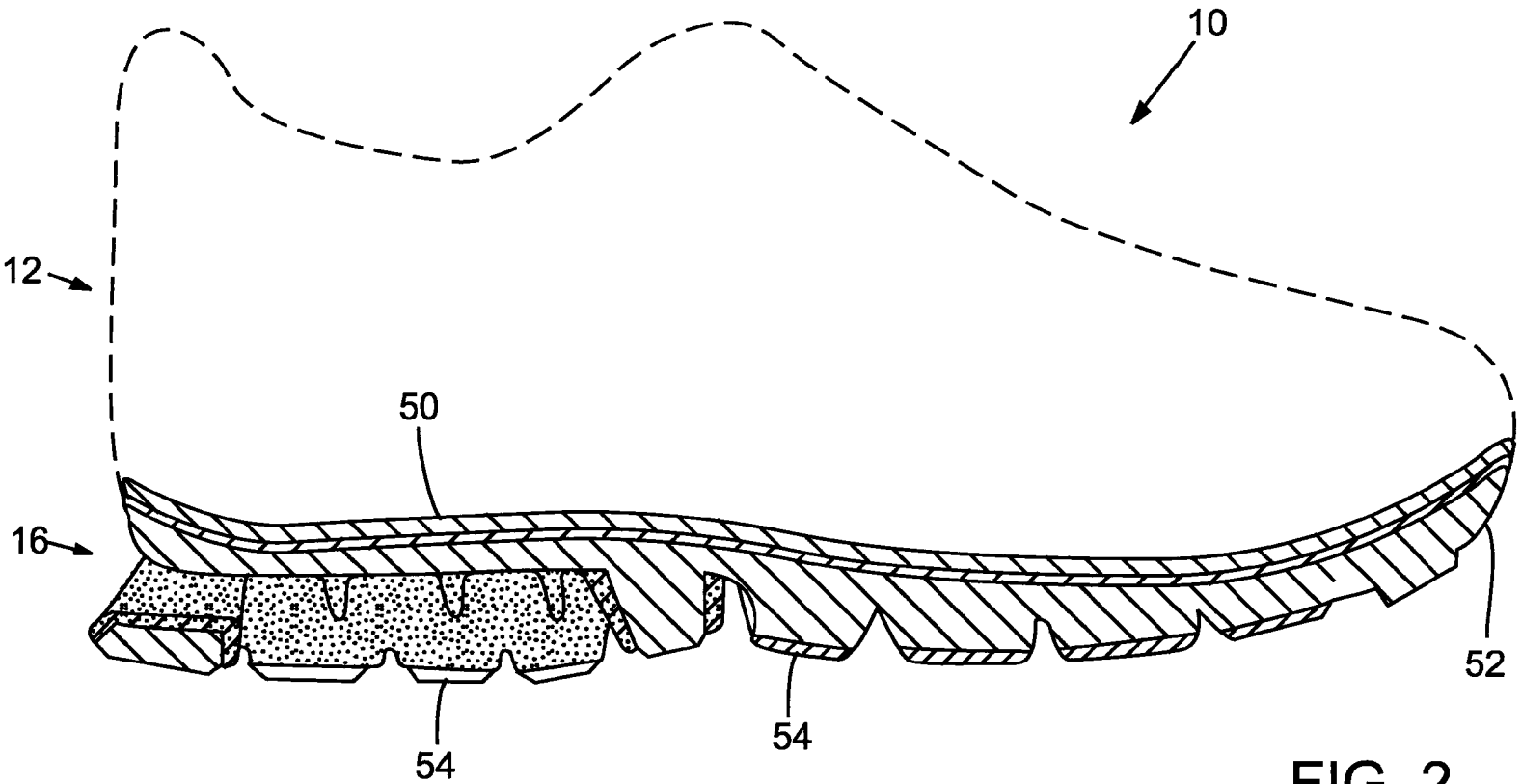
FIG. 2 is a cross-sectional view of the article of footwear taken along the line 2-2 of FIG. 1.

With particular reference to FIG. 2, the sole structure 16 is shown as including an insole 50, a midsole 52, and an outsole 54. The insole 50, midsole 52, and outsole 54 cooperate to both protect the foot 14 during use, as well as to absorb energy associated with the article of footwear 10 contacting the ground during use. Absorbing the energy associated with the article of footwear 10 contacting the ground reduces the amount of force transmitted to the foot 14 as a result of the article of footwear 10 contacting the ground and, as such, provides the foot 14 with increased comfort and protection. In one configuration, the sole structure 16, including the midsole 52 and the outsole 54, are secured to the upper structure 12 by an adhesive while the insole 50 is secured to a strobel material (not shown) of the upper structure 12.

The insole 50 is disposed within an interior portion of the article of footwear 10 such that the insole 50 is generally surrounded by the upper structure 12. The insole 50 is positioned within the article of footwear 10 such that a bottom portion of the foot 14, when inserted, is fully supported and is in contact with the insole 50. The insole 50 includes a shape that generally conforms to a shape of a bottom portion of the foot 14 and may include a material that absorbs and otherwise directs moisture away from the foot 14. The insole 50 may be secured to the strobel material of the upper structure 12 via adhesive to prevent removal of the insole 50 from the article of footwear 10. Alternatively, the insole 50 may rest on the strobel material without being adhered to the strobel material to allow removal and/or replacement of the insole 50.

In one construction, the midsole 52 is molded of a foam material such as thermoplastic polyurethane (TPU). The TPU material provides the article of footwear 10 with a lightweight and durable construction while concurrently providing the foot 14 with support and stability. In addition to providing the article of footwear 10 with a degree of comfort, durability, and stability, the TPU material also provides the article of footwear 10 with a stylish appearance, as the TPU material readily accepts various dyes and, as such, can be formed in virtually any color. Depending upon the particular requirements for the article of footwear 10, however, the midsole 52 may be molded from a variety of alternate materials, such as ethylene vinyl acetate (EVA), rubber, or injection pylon.

As described above, the TPU material provides the article of footwear 10 with a lightweight construction. While conventional footwear incorporates a similarly constructed polyurethane material (PU), the TPU material is a lighter-weight material in comparison and, as such, may be used in constructing an article of footwear that is specific to children. As such, the midsole 52 of the article of footwear 10 is formed from a TPU material to provide the midsole 52 with support and stability while concurrently maintaining the weight of the midsole 52 within a predetermined range suitable for an article of footwear intended for use by children.

Figure 3:
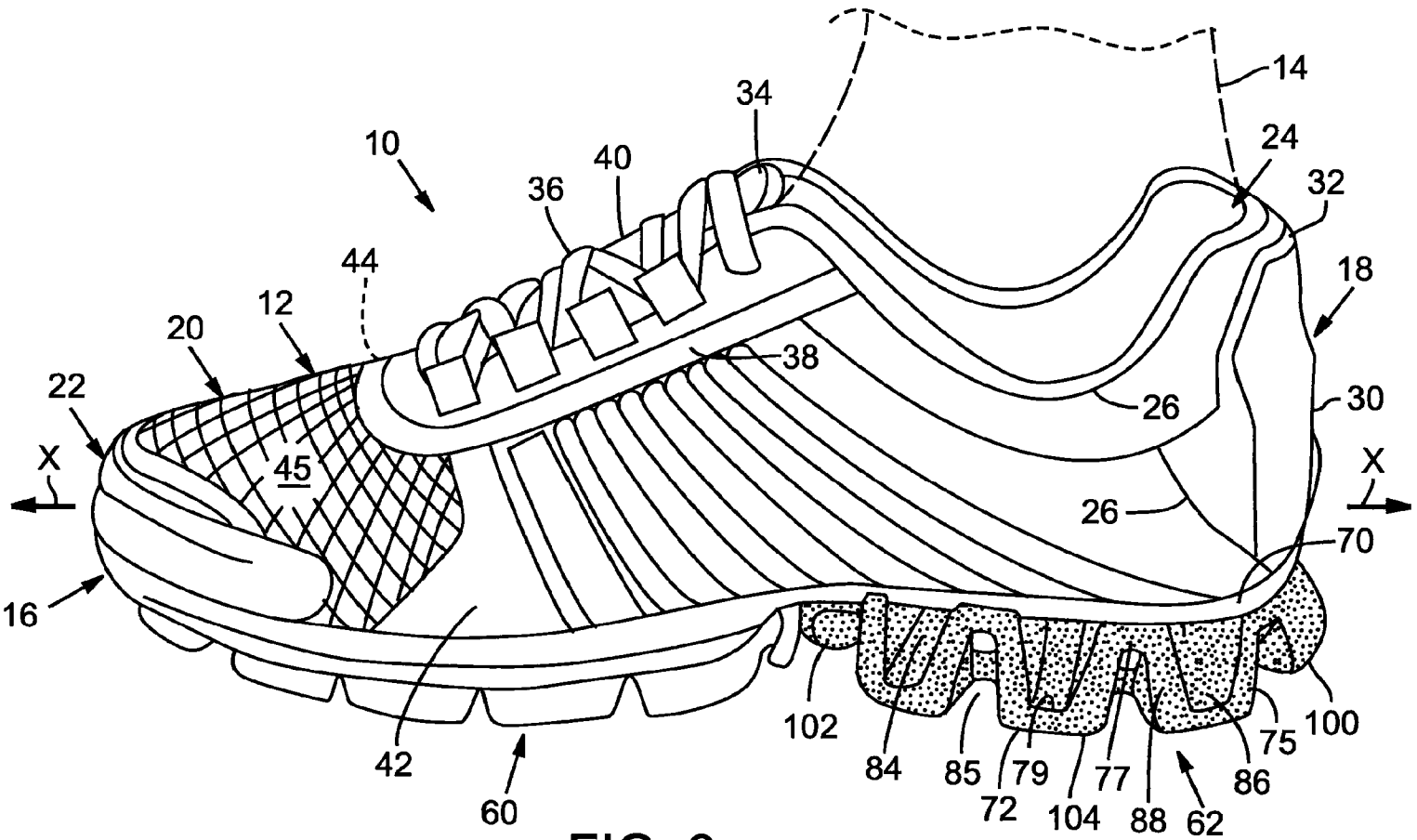
FIG. 3 is a side view of the article of footwear of FIG. 1.
Figure 4:
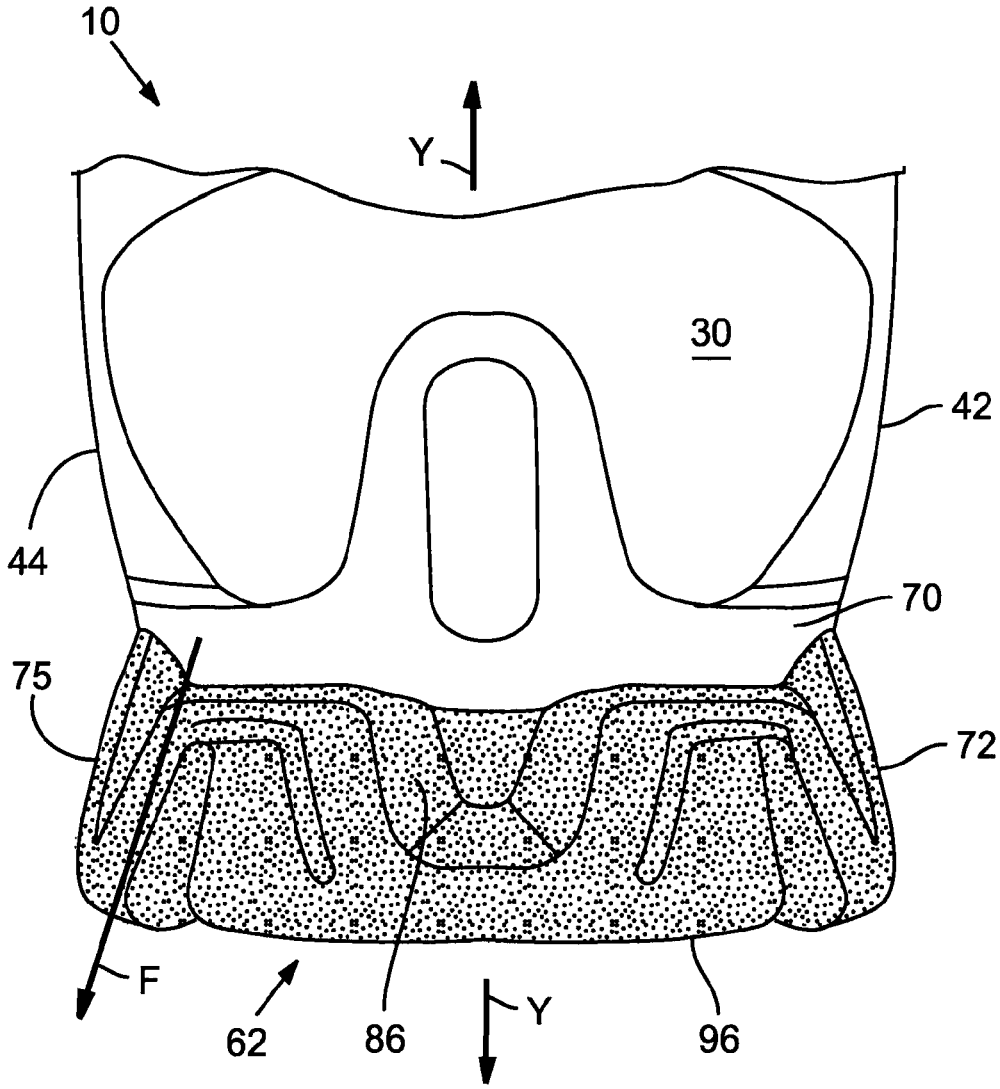
FIG. 4 is a rear view of the article of footwear of FIG. 1.
Figure 5:
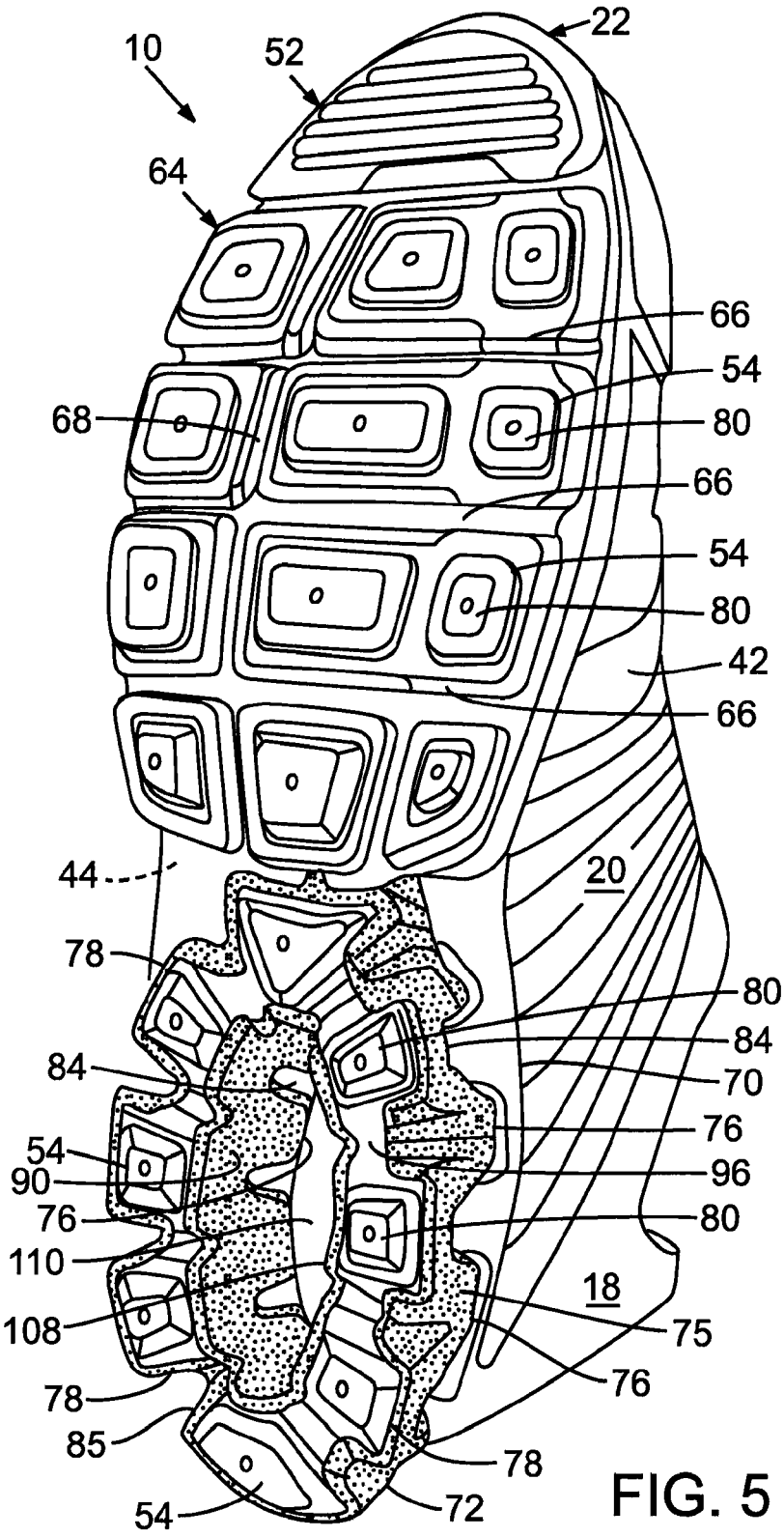
FIG. 5 is a bottom view of the article of footwear of FIG. 1.

Referring now to FIGS. 3-5, the midsole 52 is separated into a forefoot or anterior portion 60 located under the metatarsals and phalanges of the foot 14 and a rear-foot or posterior portion 62 located under the calcaneus or heel of the foot 14. The TPU mold form of the forefoot portion 60 may include a flex groove pattern 64 having a plurality of medio-lateral concavities 66 and an antero-posterior concavity 68. The plurality of medio-lateral concavities 66 are in a parallel arrangement spanning from the medial side 42 to the lateral side 44 of the article of footwear 10. During ambulatory movement, the medio-lateral concavities 66 allow the midsole 52 to flex in response to movement of the foot 14. Likewise, the antero-posterior concavity 68, which runs in an arc-shape from the toe box 22 region to the posterior portion 62, allows the foot 14 to pronate in response to the ambulatory movement. This arrangement of the concavities 66, 68 allows for proper flexion of the foot 14 during movement.

The rear-foot portion 62 of the midsole 52 includes an external moderator plate 70 and a heel puck 72. The external moderator plate 70 extends substantially the length of the midsole 52 from the medial side 42 to the lateral side 44 and includes a curvilinear shape that extends over lower portions of the rear 18 and the vamp 20. The moderator plate 70 is fixedly attached to the rear 18 and vamp 20 by any combination of injection molding, epoxy, stitching, and high-frequency welding. The design of the moderator plate 70 incorporates—in one integral unit—a rear-foot stability component and an external-arch support. The moderator plate 70 is formed from a TPU material, which provides the moderator plate 70 with a durable and lightweight construction.

The moderator plate 70 is described as being formed of a TPU material, however, the moderator plate 70 may alternatively be a composite material, a polyether block amide material (i.e. Pebax®), or other plastic material. The specific properties required for each location on the article of footwear 10 dictate the particular material or processing steps for the respective location.

The heel puck 72 may be molded from a TPU material, an EVA material, or other rubber material, and is generally an ovular-shaped, serpentine deflection unit having a central hole 74. The serpentine shape is formed by a continuous wall formation 75 surrounding the central hole 74. The wall formation 75 includes a series of peaks 77 and a series of valleys 79 that cooperate to define a plurality of pockets or voids 84 between the wall formation 75 and the moderator plate 70. The peaks 77 contact and are adhered to the moderator plate 70, while the valleys 79 are spaced apart and separated from the moderator plate 70 such that each valley 79 is disposed between a pair of peaks 77. A portion of the wall formation 75 disposed between adjacent valleys 79 is generally open to the ground during use and similarly defines a series of pockets or voids 85 between the wall formation 75 and the ground during use. The pockets 84, 85 cooperate with the TPU material and serpentine shape of the wall formation 75 to both absorb impact forces and provide support to the article of footwear 10.

As shown in FIG. 5, the serpentine shape of the wall formation 75 is a continuous structure that surrounds the posterior portion 62 of the article of footwear 10. The pockets 84, 85 defined by the wall formation 75 extend both between the serpentine structure and the moderator plate 70, as well as between the serpentine structure and the ground, as described above. The pockets 84, 85 may be formed such that a taper 86 extends from an outer surface 88 (FIG. 3) to an inner surface 90 (FIG. 5) of the wall formation 75. The taper 86 may be formed in each pocket 84, 85 or in one of the pockets 84, 85 such that an area, shape, and/or volume of the pocket 84, 85 varies between the outer surface 88 and the inner surface 90 of the wall formation 75. For example, the taper 86 may be formed such that a pocket 84, 85 decreases in size as the pocket 84, 85 extends from the outer surface 88 to the inner surface 90.

Providing the pockets 84 with the foregoing taper 86 allows for the article of footwear 10 to deflect as forces are applied to the article of footwear 10 in a direction substantially perpendicular to a longitudinal axis X (FIG. 3) while concurrently providing stability to a central portion of the heel of the foot 14. In other words, providing the pockets 84, 85 with a greater size proximate to the outer surface 88 of the heel puck 72 allows the article of footwear 10 to flex at the outer surface 88 a greater degree when compared to a central portion of the heel puck 72 disposed proximate to the inner surface 90.

The outer surface 88 of the wall formation 75 may be formed at an angle relative to an axis Y (FIG. 4) that is substantially perpendicular to both the longitudinal axis X and to a bottom surface 96 of the article of footwear 10. Forming the outer surface 88 of the heel puck 72 at an angle relative to axis Y allows the heel puck 72 to widen as the heel puck 72 extends from the moderator plate 70. In other words, the portion of the heel puck 72 disposed proximate to and attached to the moderator plate 70 is closer to axis Y when compared to the portion of the heel puck 72 disposed proximate to the ground during use. Providing the heel puck 72 with an outer surface 88 that is angled relative to axis Y, as set forth above and shown in FIG. 4, provides the article of footwear 10 and, thus, the foot 14 disposed within the article of footwear 10, with stability during standing, running, jumping, and the like.

With particular reference to FIG. 3, the bottom surface 96 of the heel puck 72 is shown to include a substantially convex shape. The substantially convex shape of the bottom surface 96 of the heel puck 72 allows a rear portion 100 and front portion 102 of the wall formation 75 to be spaced apart from the ground a greater distance than a central portion 104 of the wall formation 75 when the article of footwear 10 is at rest. Spacing apart the rear portion 100 of the wall formation 75 from the ground when the article of footwear 10 is at rest facilitates movement of the article of footwear relative to the ground by providing a clearance between the rear portion 100 and the ground and by properly positioning the rear portion 100 for heal strike during use. Specifically, during walking, running, and jogging, prior to the bottom surface 96 of the heel puck 72 contacting the ground, the bottom surface 96 is positioned at an angle relative to the ground to allow the heel of the foot 14 to contact the ground before the ball of the foot 14.

Spacing the rear portion 100 of the heel puck 72 from the ground when the article of footwear 10 is at rest positions the rear portion 100 of the heel puck 72 such that the rear portion 100 opposes the ground when the bottom surface 96 is at an angle relative to the ground to allow the rear portion 100 to contact the ground before the ball of the foot 14 to aid in motion of the foot 14. Likewise, as the article of footwear 10 is caused to flex due to a bending motion of the foot 14 such that the forefoot portion 60 of the article of footwear 10 is bent relative to the heel puck 72, the front portion 102 of the heel puck 72 is positioned to contact the ground and further support the foot 14.

Forming the heel puck 72 from a cushioning material works in conjunction with the serpentine structure and pockets 84 defined by the wall formation 75 to provide the heel puck 72 with a degree of flexibility and strength. The TPU material, in combination with the serpentine structure and pockets 84, are suitable for use in children's footwear, as the combination of the serpentine structure, pockets 84, and TPU material cooperate to provide a child with the proper balance of energy absorption, support, and durability.

In addition to providing the article of footwear 10 with durability, comfort, and performance, the heel puck 72 also improves the overall aesthetic appearance of the article of footwear 10 and provides the article of footwear 10 with an area in which a manufacturer can display a logo or other symbol. Specifically, as shown in FIG. 5, the heel puck 72 includes an opening 108 having a substantially oval shape defined by the serpentine structure of the wall formation 75. The opening 108 exposes a bottom surface 110 of the moderator plate 70, which may be used to display a logo and/or other symbol indicating the type of footwear and/or manufacturer of the footwear.

The serpentine structure of the wall formation 75, as described above, generally surrounds the surface 110 of the moderator plate 70 and provides the opening 108 by which surface 110 of the moderator plate 70 is exposed. Each pocket 84, 85 may be in communication with the opening 108 such that each pocket extends from the outer surface 88 of the wall formation 75 to the inner surface 90 of the wall formation 75.

The inner surface 90 of the wall formation 75 is disposed proximate to the exposed surface 110 of the moderator plate 70 and may be formed at an angle $\phi$ relative to axis Y (FIG. 4). Specifically, the inner surface 90 may be formed at an angle $\phi$ that is similar to the angle of the outer surface 88 such that reaction forces applied on the heel puck 72 by the foot 14 are transmitted to the ground in a direction substantially parallel to the outer surface 88 and the inner surface 90. A hypothetical force F and its associated direction are schematically represented in FIG. 4 by arrow F. Transmitting a force to the ground along arrow F provides the article of footwear 10 with lateral stability during stationary and mobile use of the article of footwear 10.

With particular reference to FIG. 5, the outsole 54 is shown to include a series of protrusions 80 that provide cushioning to the foot 14 while concurrently improving traction and durability to the outsole 54. The protrusions 80 are in the form of polygonal frusta that absorb impact forces associated with the outsole 54 contacting the ground to mitigate the amount of force experienced by the midsole 52 and ultimately experienced by the foot 14.

The outsole 54 is located in both the forefoot portion 60 and the heel puck 72, and is constructed from a non-marking synthetic rubber blend that provides the outsole 54 with traction and durability. The outsole 54 and the midsole 52 may be manufactured separately, but are later stock fit together.

In use, the article of footwear 10 absorbs forces associated with walking, running, and the like by allowing the heel puck 72 of the article of footwear 10 to absorb such forces. Specifically, the serpentine structure of the wall formation 75 along with pockets 84, 85 defined generally by the serpentine structure cooperate to allow deflection of the heel puck 72 and, thus, absorption of forces associated with walking, running, and the like. The cushioning material, in combination with the foregoing features, makes the article of footwear 10 especially suitable for children.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an upper structure including a heel portion and a forefoot portion;

a plate attached to a bottom surface of said upper structure;

a sole structure attached to said plate and including a first portion associated with said heel portion and a second portion associated with said forefoot portion, said first portion including a wall formation having a continuous structure with a series of peaks disposed proximate to and in contact with said plate and a series of valleys cooperating with said peaks to define a plurality of pockets formed through said wall formation, said plurality of pockets each including a continuous taper extending from an outer surface of said wall formation to an inner surface of said wall formation that provides each of said plurality of pockets with a decreasing volume from said outer surface to said inner surface; and a central opening defined by said wall formation and exposing a bottom surface of said plate;

wherein said inner surface of said wall formation forms said central opening.

2. The article of footwear of claim 1, wherein said plurality of pockets extend from said outer surface of said wall formation to said inner surface of said wall formation and are in communication with said opening.

3. The article of footwear of claim 1, wherein said wall formation includes a serpentine shape.

4. The article of footwear of claim 1, wherein said wall formation is formed from a thermoplastic polyurethane material.

5. The article of footwear of claim 1, wherein said sole structure includes an outsole extending over at least a portion of each of said first portion and said second portion.

6. The article of footwear of claim 5, wherein said outsole is embedded in at least one of said first portion and said second portion.

7. The article of footwear of claim 1, wherein said wall formation includes a bottom surface opposing ground during use, said bottom surface including a substantially convex shape.

8. The article of footwear of claim 1, wherein a longitudinal axis of said sole structure passes through one of said valleys.

9. The article of footwear of claim 1, wherein a first portion of said wall formation opposing ground during use extends from a longitudinal axis of the article of footwear a greater distance than does a second portion of said wall formation disposed proximate to said plate.

10. A sole structure for an article of footwear including an upper structure having a heel portion, the sole structure comprising:

a first portion associated with the heel portion and including a wall formation having a continuous structure with a series of peaks disposed proximate to and in contact with the upper structure and a series of valleys cooperating with said peaks to define a plurality of pockets formed through said wall formation, said plurality of pockets continuously decreasing in size from an outer surface of said wall formation to an inner surface of said wall formation; and a central opening defined by said wall formation and exposing a bottom surface of said upper structure;

wherein said inner surface of said wall formation forms said central opening.

11. The sole structure of claim 10, wherein said plurality of pockets each include a continuous taper that provides said plurality of pockets with said continuously decreasing size.

12. The sole structure of claim 10, wherein said wall formation includes a serpentine shape.

13. The sole structure of claim 10, wherein said wall formation is formed from a thermoplastic polyurethane material.

14. The sole structure of claim 10, wherein said sole structure includes an outsole extending over at least a portion of said first portion.

15. The sole structure of claim 14, wherein said outsole is embedded in said first portion.

16. The sole structure of claim 10, wherein said wall formation includes a bottom surface opposing ground during use, said bottom surface including a substantially convex shape.

17. The sole structure of claim 10, wherein a longitudinal axis of said sole structure passes through one of said valleys.

18. The sole structure of claim 10, wherein a first portion of said wall formation opposing ground during use extends from a longitudinal axis of the sole structure a greater distance than does a second portion of said wall formation disposed proximate to the bottom surface of the upper structure.

* * * * *